US010590934B2

(12) United States Patent
Sakima et al.

(10) Patent No.: US 10,590,934 B2
(45) Date of Patent: Mar. 17, 2020

(54) REFRIGERATION CYCLE DEVICE WITH MOTOR SPEED ESTIMATOR

(71) Applicant: Panasonic Intellectual Property Management Co., Ltd., Osaka (JP)

(72) Inventors: Fuminori Sakima, Shiga (JP); Akira Fujitaka, Shiga (JP); Hiroaki Nakai, Shiga (JP); Akihiro Kyogoku, Kyoto (JP); Hideaki Matsuo, Osaka (JP); Shigehiro Sato, Shiga (JP); Kenji Takaichi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 23 days.

(21) Appl. No.: 15/567,558

(22) PCT Filed: Jun. 7, 2016

(86) PCT No.: PCT/JP2016/002732

§ 371 (c)(1),
(2) Date: Oct. 18, 2017

(87) PCT Pub. No.: WO2016/199396

PCT Pub. Date: Dec. 15, 2016

(65) Prior Publication Data

US 2018/0156217 A1 Jun. 7, 2018

(30) Foreign Application Priority Data

Jun. 11, 2015 (JP) ..... 2015-117977

(51) Int. Cl.
*F25B 49/02* (2006.01)
*F04C 29/00* (2006.01)
(Continued)

(52) U.S. Cl.
CPC ..... *F04C 29/0007* (2013.01); *F04B 39/00* (2013.01); *F04B 39/0094* (2013.01);
(Continued)

(58) Field of Classification Search
CPC ..... F25B 9/006; F25B 49/02; F25B 49/025
See application file for complete search history.

(56) References Cited

U.S. PATENT DOCUMENTS 5,371,645 A * 12/1994 Mochizuki ..... H02H 7/0833 361/22
5,712,551 A * 1/1998 Lee ..... H02P 6/22 318/466
(Continued)

FOREIGN PATENT DOCUMENTS

CN 103562338 A 2/2014
EP 1257038 11/2002
(Continued)

OTHER PUBLICATIONS

Singapore Written Opinion dated Aug. 2, 2018 for the related Singapore Patent Application No. 11201708870R.
(Continued)

*Primary Examiner* — Jonathan Bradford
(74) *Attorney, Agent, or Firm* — Hamre, Schumann, Mueller & Larson, P.C.

(57) ABSTRACT

The present invention includes a refrigeration cycle circuit that includes compressor, indoor heat exchanger, expansion valve, and outdoor heat exchanger that are connected to each other. A working fluid containing R1123 (1,1,2-trifluoroethylene) and R32 (difluoromethane) is used as a refrigerant sealed in the refrigeration cycle circuit, and an electric motor driving device that drives an electric motor of compressor includes a rotational speed estimator. The rotational speed estimator estimates rotational speed based on information on a detection value of an electric current input to the electric motor or a magnetic pole position of a rotor that constitutes the electric motor.

12 Claims, 6 Drawing Sheets

(51) Int. Cl.

| | |
|---|---|
| ***F04B 49/10*** | (2006.01) |
| ***F04B 39/00*** | (2006.01) |
| ***F25B 1/00*** | (2006.01) |
| ***F25B 1/02*** | (2006.01) |
| ***F25B 9/00*** | (2006.01) |

(52) U.S. Cl.

CPC ..... *F04B 49/10* (2013.01); *F04B 49/106* (2013.01); *F04C 29/00* (2013.01); *F25B 1/00* (2013.01); *F25B 1/02* (2013.01); *F25B 9/006* (2013.01); *F25B 49/02* (2013.01); *F04C 2210/26* (2013.01)

(56) References Cited

U.S. PATENT DOCUMENTS

| | | | | |
|---|---|---|---|---|
| 2010/0293397 | A1* | 11/2010 | Pham | F04B 49/065 713/300 |
| 2014/0070132 | A1 | 3/2014 | Fukushima | |
| 2014/0077123 | A1 | 3/2014 | Fukushima | |

FOREIGN PATENT DOCUMENTS

| | | | |
|---|---|---|---|
| JP | 2001-115963 | | 4/2001 |
| JP | 2003-348898 | | 12/2003 |
| JP | 2007-116770 | | 5/2007 |
| JP | 2009-108837 | A | 5/2009 |
| JP | 2009-142004 | | 6/2009 |
| JP | 2010-259131 | | 11/2010 |
| JP | 2011-004515 | | 1/2011 |
| JP | 2014-075971 | | 4/2014 |
| JP | 2014-098166 | A | 5/2014 |
| JP | 2015-007257 | | 1/2015 |
| WO | 2012/157764 | | 11/2012 |
| WO | 2012/157765 | | 11/2012 |

OTHER PUBLICATIONS

International Search Report of PCT application No. PCT/JP2016/002732 dated Sep. 6, 2016.

Chinese Search Report dated Jun. 12, 2019 for the related Chinese Patent Application No. 201680025117.2, 3 pages.

* cited by examiner

REFRIGERATION CYCLE DEVICE WITH MOTOR SPEED ESTIMATOR

This application is a U.S. national stage application of the PCT international application No. PCT/JP2016/002732.

TECHNICAL FIELD

The present invention relates to a refrigeration cycle device using a working fluid containing R1123.

BACKGROUND ART

In a typical refrigeration cycle device, a compressor, a four-way valve of necessary), a heat radiator (or a condenser), a decompressor such as a capillary tube or an expansion valve, an evaporator, and the like are connected through a pipe so as to constitute a refrigeration cycle. By circulating a refrigerant through the refrigeration cycle, cooling or heating action is achieved.

As a refrigerant used in a refrigeration cycle device, halogenated hydrocarbon induced from methane or ethane called chlorofluorocarbon (according to the U.S. standard ASHRAE34, a code starting from "R" is used to refer to chlorofluorocarbon, and therefore chlorofluorocarbon is hereinafter referred to as a code starting from "R").

R410A is often used as a refrigerant for use in a refrigeration cycle device, but R410A has great global warming potential (GWP) of 2090 and is therefore undesirable from the perspective of prevention of global warming.

From the perspective of prevention of global warming, for example, R1123 (1,1,2-trifluoroethylene) and R1132 (1,2-difluoroethylene) have been proposed as refrigerants having small GWP (see, for example, PTL 1 or PTL 2).

CITATION LIST

Patent Literatures

PTL1: WO 2012/157764 A
PTL2: WO 2012/157765 A

SUMMARY OF THE INVENTION

However, R1123 (1,1,2-trifluoroethylene) and R1132 (1,2-difluoroethylene) are less stable than conventional refrigerants such as R410A and therefore has a risk of changing into another chemical compound due to a disproportionation reaction in a case where a radical is generated. The disproportionation reaction involves release of large heat and therefore has a risk of deteriorating reliability of a compressor and a refrigeration cycle device. Therefore, in order to use R1123 and R1132 in a compressor and a refrigeration cycle device, it is necessary to suppress the disproportionation reaction.

The present invention provides, as a refrigeration cycle device for use in an air conditioner or the like, a refrigeration cycle device that is more suitable for use of a working fluid containing R1123.

A refrigeration cycle device according to the present invention includes a refrigeration cycle circuit that includes a compressor including an electric motor; a condenser; an expansion valve; and an evaporator; the compressor, the condenser, the expansion valve, and the evaporator being connected to each other. Furthermore, a working fluid containing 1,1,2-trifluoroethylene and difluoromethane is used as a refrigerant sealed in the refrigeration cycle circuit, an electric motor driving device that drives the electric motor is provided, and the electric motor driving device includes a rotational speed estimator.

According to this configuration, a rotation state of the electric motor is detected, and therefore supply of electric power to the electric motor can be stopped upon occurrence of rotation abnormality of the electric motor. This makes it possible to suppress a disproportionation reaction resulting from activation of molecular motion of R1123 in the working fluid, thereby increasing reliability.

DESCRIPTION OF EMBODIMENT

An exemplary embodiment of the present invention will be described below with reference to the drawings. The present invention is not limited by the exemplary embodiment.

First Exemplary Embodiment

Figure 1:
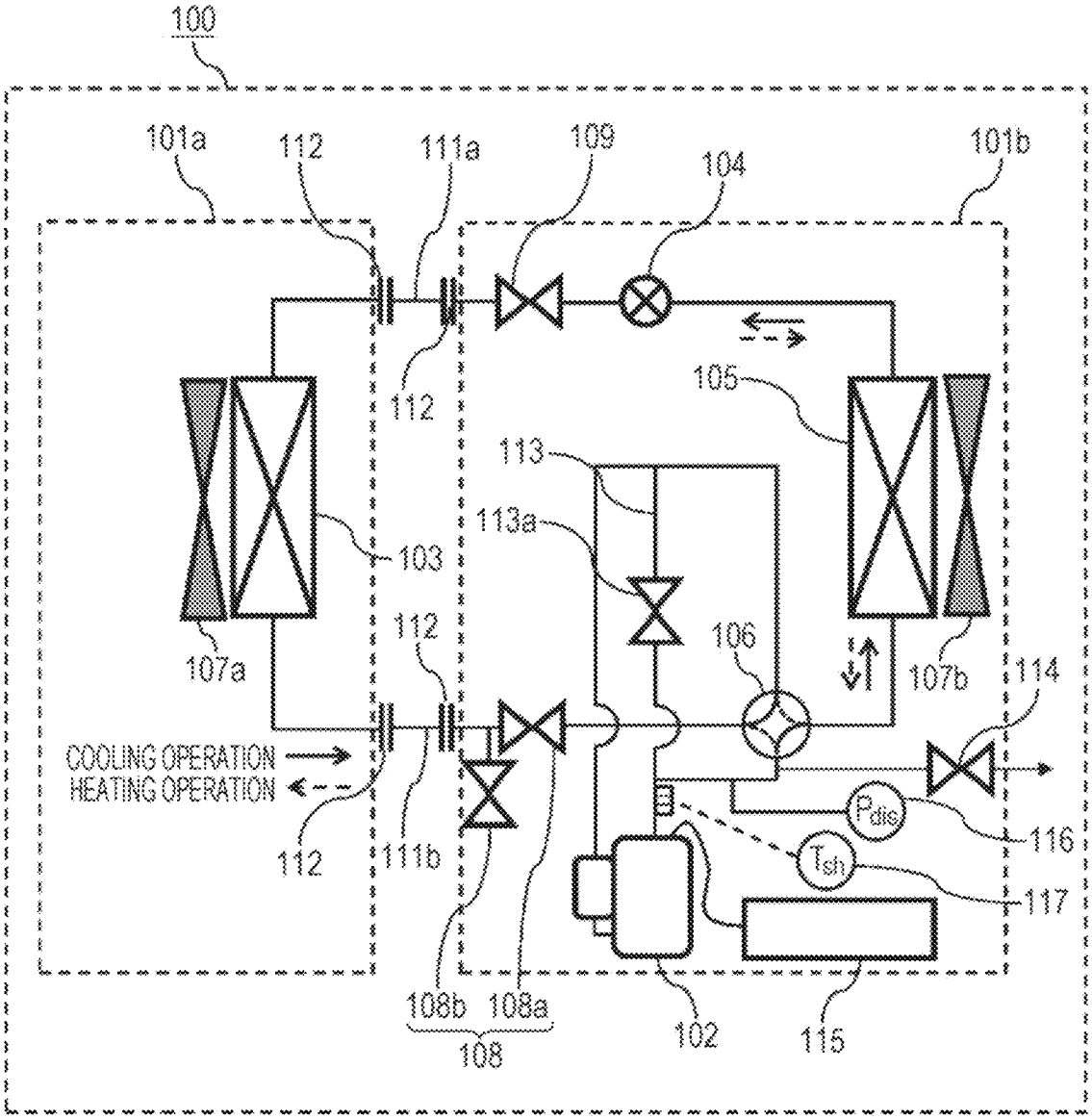
FIG. 1 illustrates an outline configuration diagram of a refrigeration cycle device according to a first exemplary embodiment of the present invention.

FIG. 1 illustrates a refrigeration cycle device according to a first exemplary embodiment of the present invention. Refrigeration cycle device 100 according to the present exemplary embodiment is a so-called separate-type air conditioner in which indoor unit 101*a* and outdoor unit 101*b* are connected to each other through refrigerant pipes, control wires, and the like.

Indoor unit 101*a* includes indoor heat exchanger 103 and indoor blower fan 107*a* that is a cross flow fan for blowing air toward indoor heat exchanger 103 and blowing out air that has exchanged heat with indoor heat exchanger 103 into a room. Outdoor unit 101*b* includes compressor 102, expansion valve 104 that is a decompressor, outdoor heat exchanger 105, four-way valve 106, and outdoor blower fan 107*b* that is a propeller fan for blowing air toward outdoor heat exchanger 105.

Indoor unit 101*a* includes pipe connectors 112 such that indoor unit 101*a* and outdoor unit 101*b* can be separated from each other. Outdoor unit 101*b* includes pipe connectors 112, three-way valve 108 made up of two-way valves 108*a* and 108*b* that are provided between pipe connector 112 and four-way valve 106, and two-way valve 109 that is provided between pipe connector 112 and expansion valve 104. Furthermore, indoor unit 101*a* includes electric motor driving device 115 that drives an electric motor provided in compressor 102.

One of pipe connectors 112 of indoor unit 101*a* and one of pipe connectors 112 of outdoor unit 101*b* on a side of two-way valve 109 are connected to each other by liquid pipe 111*a* that is one of refrigerant pipes. The other one of pipe connectors 112 of indoor unit 101*a* and the other one of pipe connectors 112 of outdoor unit 101*b* on a side of three-way valve 108 are connected to each other by gas pipe 111*b* that is one of the refrigerant pipes.

In refrigeration cycle device 100 according to the present exemplary embodiment, compressor 102, indoor heat exchanger 103, expansion valve 104, outdoor heat exchanger 105 are mainly connected in this order by the refrigerant pipes so as to constitute a refrigeration cycle circuit. The refrigeration cycle circuit includes, between compressor 102 and indoor heat exchanger 103 or outdoor heat exchanger 105, four-way valve 106 that changes a direction of flow of a refrigerant discharged from compressor 102 toward indoor heat exchanger 103 or outdoor heat exchanger 105.

Four-way valve 106 allows refrigeration cycle device 100 according to the present exemplary embodiment to switch between cooling operation and heating operation. Specifically, during cooling operation, four-way valve 106 is switched such that a discharge side of compressor 102 and outdoor heat exchanger 105 are communicated with each other and such that indoor heat exchanger 103 and an introduction side of compressor 102 are communicated with each other. This allows indoor heat exchanger 103 to act as an evaporator that absorbs heat from surrounding atmosphere (indoor air) and allows outdoor heat exchanger 105 to act as a condenser that releases heat absorbed in a room to surrounding air (outdoor air). Meanwhile, during heating operation, four-way valve 106 is switched such that the discharge side of compressor 102 and indoor heat exchanger 103 are communicated with each other and such that outdoor heat exchanger 105 and the introduction side of compressor 102 are communicated with each other. This allows outdoor heat exchanger 105 to act as an evaporator that absorbs heat from surrounding atmosphere (outdoor air) and allows indoor heat exchanger 103 to act as a condenser that releases heat absorbed outside the room to indoor air.

As four-way valve 106, an electromagnetic valve that switches between cooling and heating in accordance with an electric signal supplied from a control device (not illustrated) is used.

Furthermore, the refrigeration cycle circuit includes bypass pipe 113 that bypasses four-way valve 106 and allows the introduction side and the discharge side of compressor 102 to communicate with each other and opening/closing valve 113*a* that opens and closes flow of a refrigerant through bypass pipe 113.

Furthermore, relief valve 114 that is an electronically-controlled opening/closing valve is provided on the discharge side of compressor 102. Although it is only necessary that relief valve 114 be provided between a discharge portion of compressor 102 and expansion valve 104 or between the discharge portion of compressor 102 and three-way valve 108, it is desirable that relief valve 114 be provided between the discharge portion of compressor 102 and four-way valve 106 in order to rapidly release pressure of compressor 102.

The refrigeration cycle circuit includes high-pressure-side pressure detector 116 that is provided between the discharge side of compressor 102 and an inlet of expansion valve 104. High-pressure-side pressure detector 116 may be configured to electrically detect and measure strain of a pressurized diaphragm by using a strain gauge or the like. High-pressure-side pressure detector 116 may be metal bellows or a metal diaphragm that mechanically detects a pressure.

The refrigeration cycle circuit includes discharge temperature detector 117 that is provided between the discharge side of compressor 102 and an inlet of the condenser. In the present exemplary embodiment, either indoor heat exchanger 103 or outdoor heat exchanger 105 acts as a condenser as a result of switching of four-way valve 106. Accordingly, discharge temperature detector 117 is provided between the discharge side of compressor 102 and the inlet of four-way valve 106. Discharge temperature detector 117 is realized, for example, by a thermistor or a thermocouple and electrically detects a temperature.

Values detected by high-pressure-side pressure detector 116 and discharge temperature detector 117 are electrically transmitted to the control device.

A working fluid (refrigerant) is sealed in the refrigeration cycle circuit. The working fluid is described below. The working fluid sealed in refrigeration cycle device 100 according to the present exemplary embodiment is a mixed working fluid containing two components that are R1123 (1,1,2-trifluoroethylene) and R32 (difluoromethane), especially a mixed working fluid containing not less than 30% by weight and not more than 60% by weight of R32.

Mixture of not less than 30% by weight of R32 in R1123 makes it possible to suppress a disproportionation reaction of R1123. A higher concentration of R32 makes it possible to suppress the disproportionation reaction better. Specifically, the disproportionation reaction of R1123 can be suppressed because of an effect of mitigating a disproportionation reaction due to small polarization of R32 to a fluorine atom and an effect of making the disproportionation reaction less frequent because R1123 and R32, which have similar physical properties, behave in unison at the time of a phase change such as condensation or evaporation.

A mixed refrigerant containing 30% by weight of R32 and 70% by weight of R1123 has an azeotropic point and does not undergo temperature slide, and therefore can be handled in a similar manner to a single refrigerant. Mixture of not less than 60% by weight of R32 may undesirably make temperature slide large and make it difficult to handle the mixed refrigerant in a similar manner to a single refrigerant. It is therefore desirable that not more than 60% by weight of R32 be mixed. In particular, it is desirable that the mixed refrigerant contains not less than 40% by weight and not more than 50% by weight of R32 in order to prevent disproportionation, reduce temperature slide so as to aim for the azeotropic point, and make design of the device easy.

Tables 1 and 2 show comparison results in which cooling performance and cycle efficiency (COP) are calculated for each of mixed working fluids of R1123 and R32 at mixture ratios in a range of R32 content of not less than 30% by weight and not more than 60% by weight, in a case where pressure and temperature of the refrigeration cycle and displacement volume of the compressor are not changed, and are compared with those of R410A and R1123.

First, calculation conditions of Tables 1 and 2 are described. In recent years, performance of heat exchangers is increasing for the purpose of improving cycle efficiency of devices. During actual operation, there are tendencies toward a lower condensation temperature, a higher evaporation temperature, and a lower discharge temperature. Therefore, in view of the actual operation condition, the cooling calculation condition of Table 1 is a calculation condition for cooling operation of refrigeration cycle device 100 (an indoor dry-bulb temperature: 27° C., wet-bulb temperature: 19° C., outdoor dry-bulb temperature: 35° C.) and is set such that an evaporation temperature is 15° C., a condensation temperature is 45° C., a degree of superheat of a refrigerant introduced into the compressor is 5° C., and a degree of supercooling at the outlet of the condenser is 8° C.

The heating calculation condition of Table 2 is a calculation condition for heating operation of refrigeration cycle device 100 (an indoor dry-bulb temperature: 20° C., outdoor dry-bulb temperature: 7° C., wet-bulb temperature: 6° C.) and is set such that an evaporation temperature is 2° C., a condensation temperature is 38° C., a degree of superheat of a refrigerant introduced into the compressor is 2° C., and a degree of supercooling at the outlet of the condenser is 12° C.

TABLE 1

| Refrigerant | | R410A | R32/R1123 60/40 | R32/R1123 50/50 | R32/R1123 40/60 | R32/R1123 30/70 | R1123 |
|---|---|---|---|---|---|---|---|
| GWP | — | 2090 | 410 | 350 | 280 | 210 | 6 |
| Condensation Pressure | MPa | 2.73 | 3.17 | 3.23 | 3.28 | 3.33 | 3.44 |
| Evaporating Pressure | MPa | 1.25 | 1.48 | 1.51 | 1.55 | 1.59 | 1.70 |
| Discharge Temperature | ° C. | 62 | 69 | 68 | 67 | 66 | 65 |
| Cooling Performance | % | 100% | 118% | 119% | 120% | 121% | 125% |
| COP | % | 100% | 97% | 96% | 95% | 94% | 91% |

TABLE 2

| Refrigerant | | R410A | R32/R1123 60/40 | R32/R1123 50/50 | R32/R1123 40/60 | R32/R1123 30/70 | R1123 |
|---|---|---|---|---|---|---|---|
| GWP | — | 2090 | 410 | 350 | 280 | 210 | 5 |
| Condensation Pressure | MPa | 2.30 | 2.69 | 2.75 | 2.79 | 2.84 | 2.95 |
| Evaporating Pressure | MPa | 0.87 | 0.96 | 0.99 | 1.01 | 1.03 | 1.14 |
| Discharge Temperature | ° C. | 56 | 65 | 64 | 63 | 62 | 60 |
| Cooling Performance | % | 100% | 118% | 119% | 120% | 121% | 125% |
| COP | % | 100% | 97% | 96% | 95% | 94% | 91% |

According to Tables 1 and 2, during cooling and heating operation, in a case where the R32 content is not less than 30% by weight and not more than 60% by weight, the cooling performance increases by approximately 20% as compared with R410A, the cycle efficiency (COP) is 94% to 97% of R410A, and the warming potential decreases to 10% to 20% of R410A.

As described above, as a two-component mixture of R1123 and R32, a mixture containing not less than 30% by weight and not more than 60% by weight of R32 is desirable, and a mixture containing not less than 40% by weight and not more than 50% by weight of R32 is more desirable when all of prevention of disproportionation, temperature slide, and the performance and COP during cooling operation and heating operation are considered (i.e., when a mixture ratio suitable for an air conditioning device using a compressor that will be described later is specified).

Next, constituent elements that constitute the refrigeration cycle circuit are described.

As indoor heat exchanger 103 and outdoor heat exchanger 105, fin-and-tube type heat exchangers or parallel flow type (micro tube type) heat exchangers are used, for example. For example, in a case where brine is used as a surrounding medium of indoor heat exchanger 103 (brine is used for cooling and heating of a living space) or a refrigerant of a cascade refrigeration cycle is used instead of a separate-type air conditioner like the one illustrated in FIG. 1, double-pipe heat exchangers, plate-type heat exchangers, or shell-and-tube heat exchangers may be used (not illustrated), as a form of the heat exchanger. In this case, indoor heat exchanger 103 does not directly cool or heat a target to be cooled or heated (indoor air in a case of a separate-type air conditioner) and therefore need not be placed in a room.

As expansion valve 104, a pulse-motor-driven electronic expansion valve is, for example, used.

Next, details of compressor 102 are described with reference to FIG. 2. Compressor 102 is a so-called hermetic rotary type compressor. Electric motor 102*e* and compression mechanism 102*c* are contained in airtight container 102*g*, and airtight container 102*g* is filled with a high-temperature high-pressure discharge refrigerant and refrigerant oil. Electric motor (motor) 102*e* is a so-called brushless motor. Electric motor 102*e* includes rotor 1021*e* that is connected to compression mechanism 102*c* and stator 1022*e* that is provided around rotor 1021*e*.

A three-phase winding wire is wound around stator 1022*e* and forms coil end 1023*e* at an end in a top-bottom direction of stator 1022*e*. Ends of the three-phase winding wire serve as lead wires 102*i*. That is, stator 1022*e* includes three lead wires 102*i* extending from the three-phase winding wire. Other ends of three lead wires 102*i* are connected to power feeding terminal 102*h*. Power feeding terminal 102*h* includes three terminals, each of which is connected to electric motor driving device 115 illustrated in FIG. 1.

Figure 2:
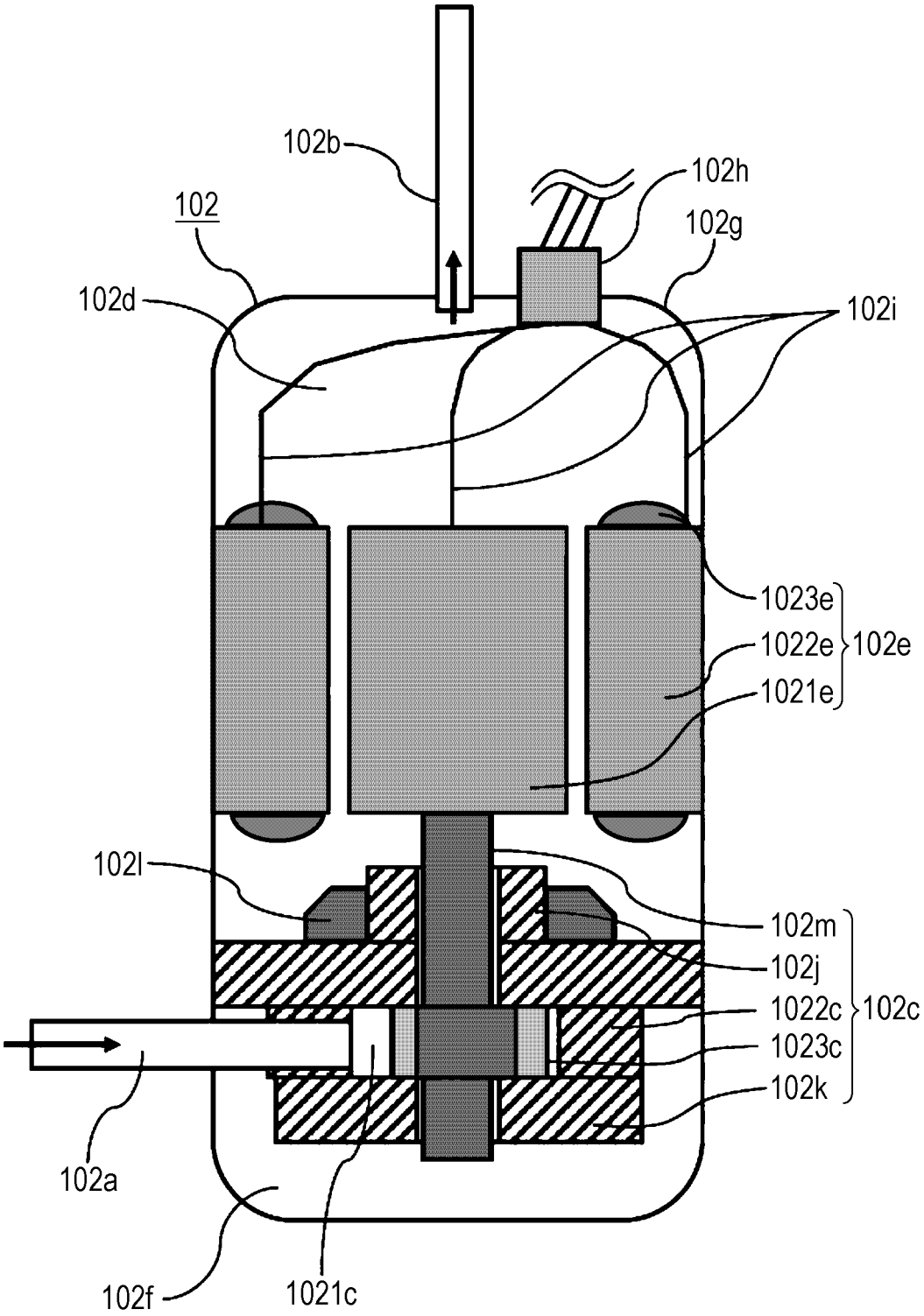
FIG. 2 illustrates an outline configuration diagram of a compressor that constitutes the refrigeration cycle device according to the first exemplary embodiment of the present invention.

As illustrated in FIG. 2, three lead wires 102*i* extend from separate positions of coil end 1023*e* on a horizontal cross section of electric motor 102*e*. More specifically, spacing between adjacent ones of three lead wires 102*i* on a side of stator 1022*e* (side of coil end 1023*e* that will be described later) is larger than spacing between the adjacent lead wires on a side of power feeding terminal 102*h*. Three lead wires 102*i* may be disposed around a center of rotation of rotor 1021*e* on the horizontal cross section of electric motor 102*e* such that one lead wire 102*i* is disposed every approximately 120 degrees.

Figure 3:
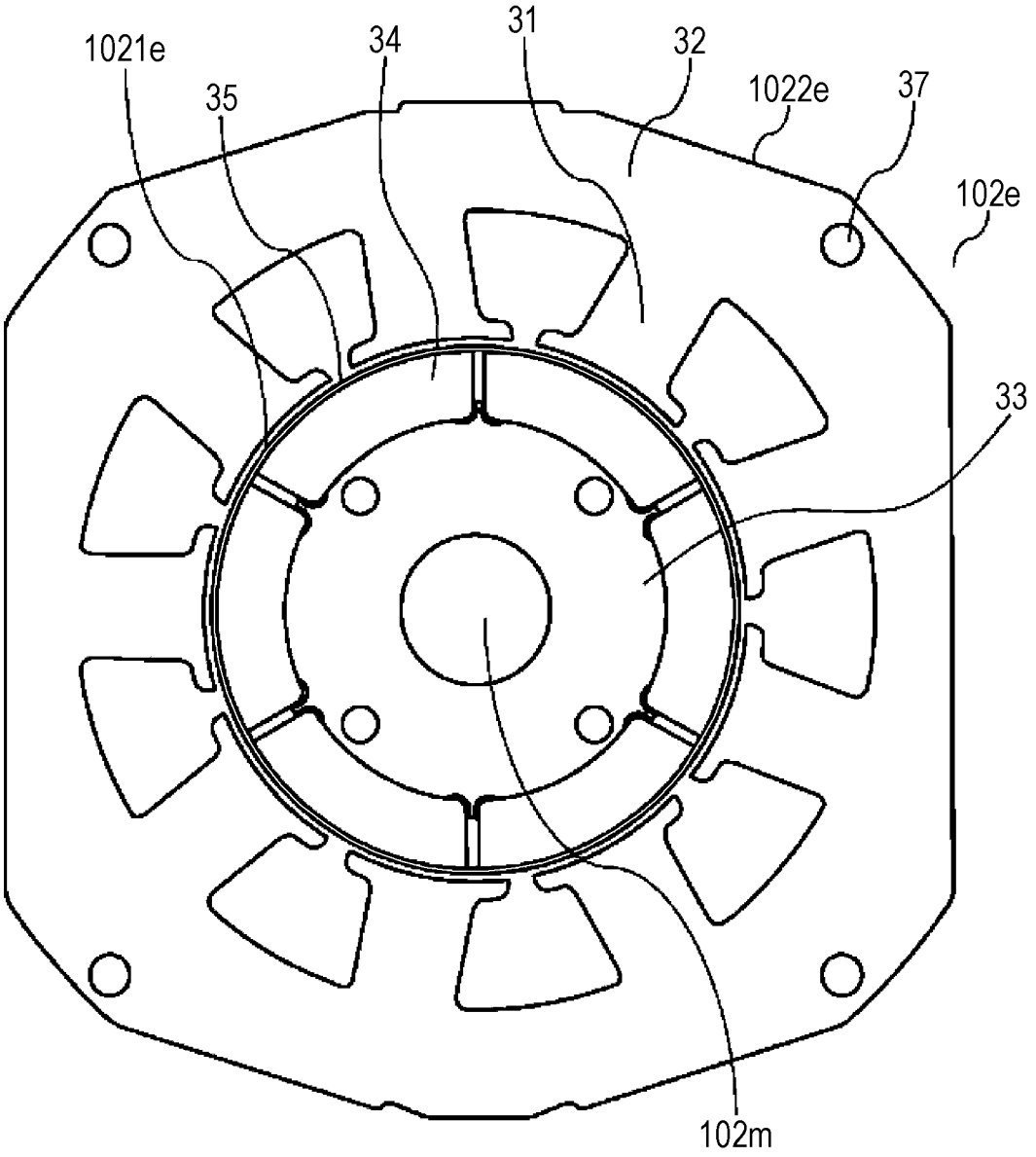
FIG. 3 illustrates an outline configuration diagram of a concentrated-winding electric motor of the compressor that constitutes the refrigeration cycle device according to the first exemplary embodiment of the present invention.

FIG. 3 is a transverse cross-sectional view of electric motor 102*e*. Electric motor 102*e* is a so-called concentrated-winding electric motor. Stator 1022*e* is made up of single teeth 31 and annular yoke 32 that connect teeth 31, and rotor 1021*e* made up of substantially cylindrical rotor core 33 and permanent magnet 34 disposed on an outer peripheral part of rotor core 33 is rotatably held around crankshaft 102*m* so as to face an inner peripheral part of stator 1022*e*. Permanent magnet 34 is fixed by providing non-magnetic (e.g., stainless) ring 35 on an outer periphery of permanent magnet 34.

Permanent magnet 34 may be fixed by using an adhesive such as an epoxy resin.

As a method for disposing permanent magnet 34, a structure in which permanent magnet 34 is disposed on the outer peripheral part of rotor core 33 has been described above. However, it is also possible to employ a structure (not illustrated) in which permanent magnet 34 is disposed on an inner side of rotor core 33.

Meanwhile, stator 1022*e* is fixed in airtight container 102*g* illustrated in FIG. 2 by being shrink-fitted in a shell of the compressor. A method for fixing stator 1022*e* is not limited to this. For example, stator 1022*e* may be fixed by a method such as welding.

A three-phase winding wire is wound around teeth 31 of stator 1022*e*, and an electric current is passed through the winding wire by a switching element of electric motor driving device 115 that will be described later such that a rotating magnetic field is generated in rotor 1021*e*. The rotating magnetic field can be generated by an inverter at a variable speed, and the inverter is operated at a high speed, for example, immediately after operation of compressor 102 and is operated at a low speed, for example, during stable operation.

Stator 1022*e* has, on an outer peripheral part, a cutout, a groove, or hole 37. That is, a portion that passes through the entire length of stator 1022*e* is provided between airtight container 102*g* and stator 1022*e* or in stator 1022*e* itself. By passing refrigerant oil through this portion, cooling action is achieved.

In the case where electric motor 102*e* is a concentrated-winding electric motor, it is possible to reduce winding resistance and markedly reduce copper loss. Furthermore, it is possible to shorten an entire motor length.

Although the case where electric motor 102*e* is a concentrated-winding electric motor has been described above, electric motor 102*e* may be a distributed-winding electric motor.

Figure 4:
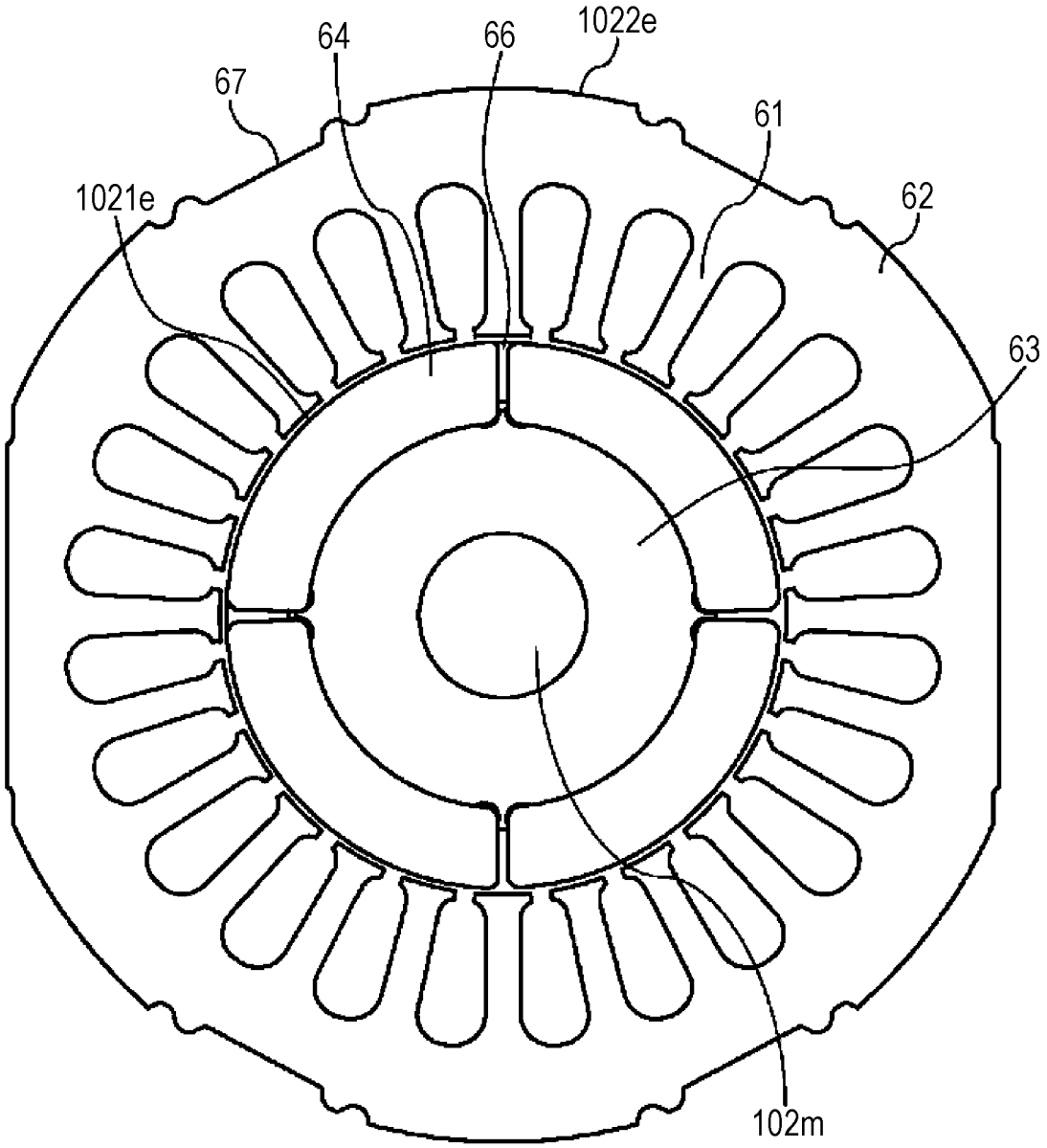
FIG. 4 illustrates an outline configuration diagram of a distributed-winding electric motor of the compressor that constitutes the refrigeration cycle device according to the first exemplary embodiment of the present invention.

FIG. 4 is a transverse cross-sectional view of distributed-winding electric motor 102*e*. Stator 1022*e* is made up of a plurality of teeth 61 and annular yoke 62 that connect teeth 61, and rotor 1021*e* made up of substantially cylindrical rotor core 63 and permanent magnet 64 disposed on an outer peripheral part of rotor core 63 is rotatably held around crankshaft 102*m* so as to face an inner peripheral part of stator 1022*e*. Permanent magnet 64 is fixed by providing non-magnetic (e.g., stainless) ring 66 on an outer periphery of permanent magnet 64. Stator 1022*e* is fixed in airtight container 102*g* illustrated in FIG. 2 by being shrink-fitted in a shell of the compressor.

Stator 1022*e* has, on an outer peripheral part, cutout 67, a groove, or a hole. By passing refrigerant oil through this portion, cooling action is achieved.

Rotor 1021*e* has four poles, and a number of teeth of stator 1022*e* is equal to a number of slots and is 12 or 24. A three-phase winding wire is wound around each slot.

A number of poles of the rotor and the number of slots of the stator may be 6 poles and 9 slots, 6 poles and 18 slots, 4 poles and 6 slots, 8 poles and 12 slots, or 10 poles and 12 slots.

In compressor 102, a low-pressure refrigerant flowing out from the evaporator is introduced from introduction pipe 102*a* via four-way valve 106, and pressure of the low-pressure refrigerant is increased by compression mechanism 102*c*. The discharge refrigerant that has reached high temperature and high pressure as a result of the increase of the pressure is discharged from discharge muffler 1021 and flows to discharge space 102*d* through gaps formed by peripheries of electric motor 102*e* (a gap between rotor 1021*e* and stator 1022*e* and a gap between stator 1022*e* and airtight container 102*g*). Then, the refrigerant is discharged from discharge pipe 102*b* to an outside of compressor 102 and is delivered toward the condenser via four-way valve 106.

Compression mechanism 102*c* is connected to electric motor 102*e* via crankshaft 102*m*. In electric motor 102*e*, electric power received from an external power source is converted from electric energy into mechanical (rotational) energy. Compression mechanism 102*c* performs compression work of increasing pressure of a refrigerant by using mechanical energy transmitted from electric motor 102*e* via crankshaft 102*m*.

Figure 5:
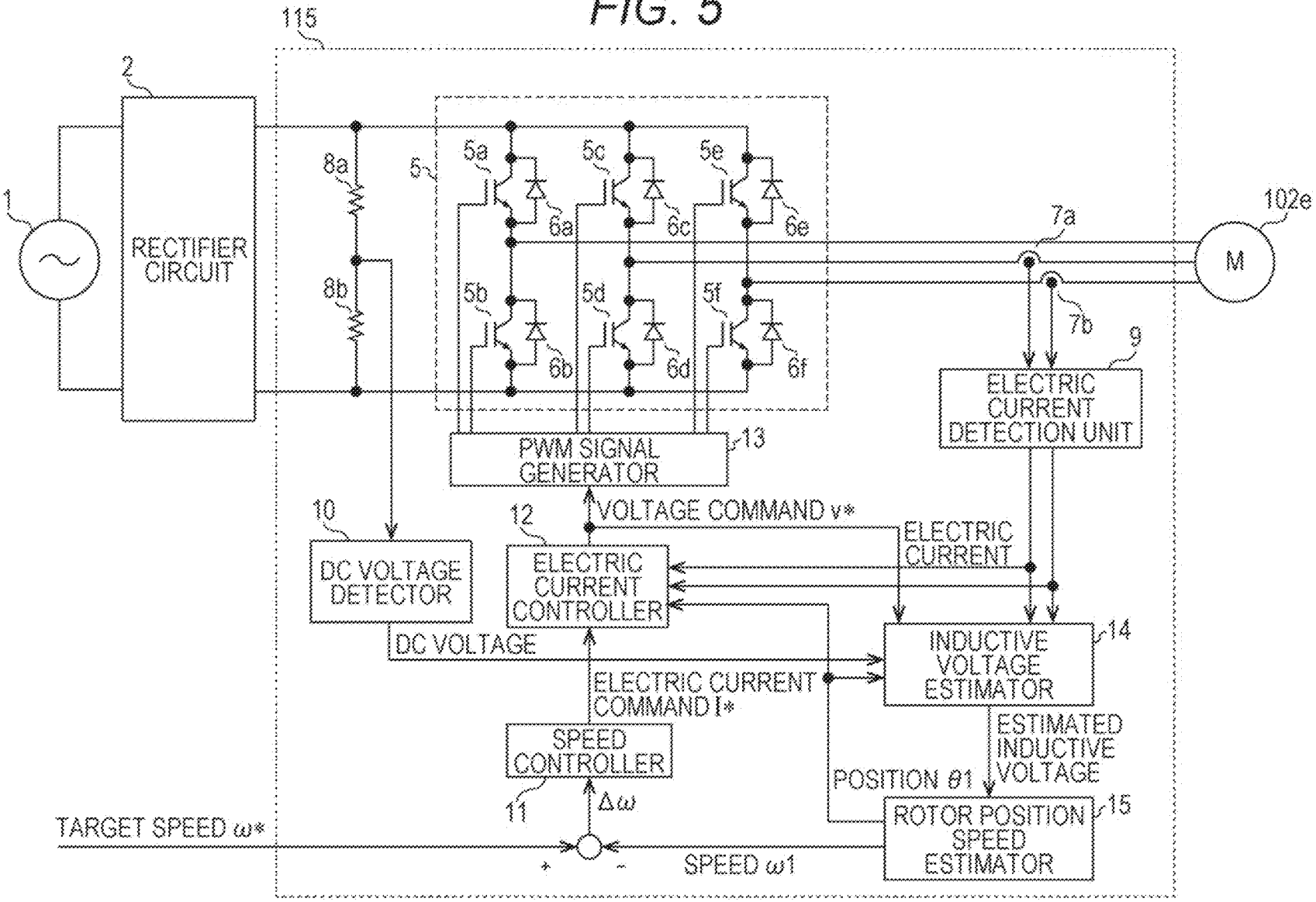
FIG. 5 illustrates a system configuration diagram of an electric motor driving device of the refrigeration cycle device according to the first exemplary embodiment of the present invention.

Next, an electric motor driving device that drives electric motor 102*e* of compressor 102 is described. FIG. 5 is a system configuration diagram of the electric motor driving device. As illustrated in FIG. 5, electric motor driving device 115 includes inverter 5 that is made up of a plurality of switching elements 5*a* through 5*f* and free wheeling diodes 6*a* through 6*f* that form pairs with the plurality of switching elements 5*a* through 5*f*, speed controller 11, electric current controller 12, pulse width modulation (PWM) signal generator 13, inductive voltage estimator 14, and rotor position speed estimator 15. Electric motor driving device 115 includes electric current detection unit 9 that detects an electric current input to electric motor 102*e* and DC voltage detector 10 that is a voltage detector for detecting a voltage input to electric motor driving device 115.

An input voltage from alternate current (AC) power source 1 is rectified into a direct current by rectifier circuit 2, and the DC voltage is converted into a three-phase AC voltage by inverter 5. This voltage drives electric motor 102*e* that is a brushless DC motor.

In electric motor driving device 115, speed controller 11 computes electric current command value I* by proportional-integral control (hereinafter referred to as PI control)

such that a speed error Δω between target speed ω* and current speed ω1 (an estimated rotational speed, i.e., a current value of an estimated speed estimated by rotor position speed estimator 15) becomes zero in order to achieve the target speed that is externally given.

Electric current controller 12 computes voltage command value V* by PI control such that an electric current error between a phase electric current command value of a stator winding wire that is created on the basis of electric current command value I* computed by speed controller 11 and an electric current detection value obtained from electric current detectors 7*a* and 7*b* and electric current detection unit 9 becomes zero.

Inductive voltage estimator 14 estimates an inductive voltage generated in each phase of the stator winding wire of electric motor 102*e* on the basis of information on the electric current detection value of electric motor 102*e* detected by electric current detectors 7*a* and 7*b* and electric current detection unit 9, voltage command value V*, and a DC voltage of inverter 5 detected by voltage dividing resistors 8*a* and 8*b* and DC voltage detector 10.

Rotor position speed estimator 15 estimates a magnetic pole position and a speed of rotor 1021*e* (see FIG. 2) in electric motor 102*e* by using the inductive voltage estimated by inductive voltage estimator 14. Electric current controller 12 generates a signal for driving switching elements 5*a* through 5*f* on the basis of the information on the estimated rotor magnetic pole position such that inverter 5 outputs voltage command value V*, and the driving signal is converted into a drive signal for electrically driving switching elements 5*a* through 5*f* by PWM signal generator 13. Switching elements 5*a* through 5*f* operate in accordance with the drive signal. According to such a configuration, electric motor driving device 115 rotates electric motor 102*e* of compressor 102 by position sensor-less sine-wave drive.

In a case where rotor position speed estimator 15 estimates that the speed of rotor 1021*e* is zero after rotation of electric motor 102*e*, electric current controller 12 stops output of voltage command value V*.

Electric motor 102*e* may be an AC motor. In this case, electric motor driving device 115 may just perform vector control instead of the position sensor-less sine-wave drive. Rotor position speed estimator 15 estimates the speed of rotor 1021*e* by using an electric current value detected by electric current detection unit 9. Alternatively, rotor position speed estimator 15 estimates a magnetic pole position and the speed of rotor 1021*e* by using an inductive voltage estimated by inductive voltage estimator 14.

Electric motor driving device 115 includes an electric current change rate computing unit (not illustrated), a DC voltage change rate calculator (not illustrated), and a storage (not illustrated).

The electric current value detected by electric current detection unit 9 is sequentially stored in the storage. The electric current change rate computing unit computes change rate ΔI of an electric current value from electric current value I detected by electric current detection unit 9 and electric current value Ia obtained a predetermined period before and stored in the storage. Then, in a case where change rate ΔI of an electric current value is equal to or larger than predetermined value ΔI0, electric current controller 12 stops output of voltage command value V*.

Figure 6:
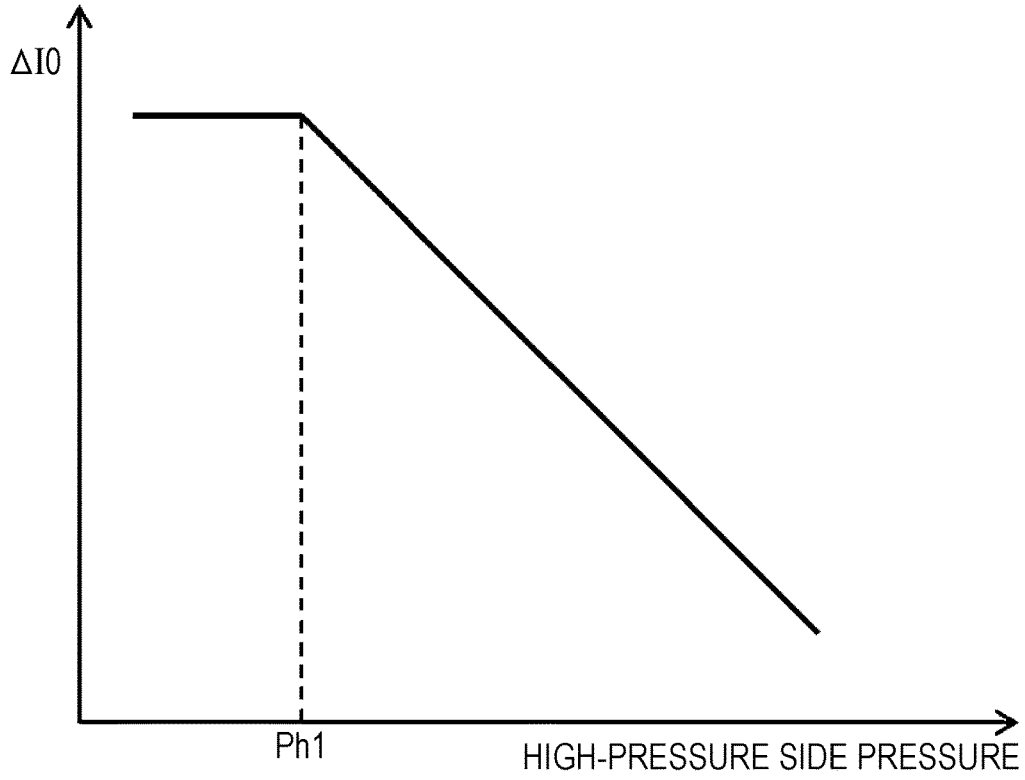
FIG. 6 illustrates a relationship between a high-pressure side pressure and a threshold value of a change rate of an electric current value in the refrigeration cycle device according to the first exemplary embodiment of the present invention.

Predetermined value ΔI0 may be a predetermined constant value but may be a threshold value set such that predetermined value ΔI0 is constant until a high-pressure side pressure reaches predetermined value Ph1 and predetermined value ΔI0 becomes smaller as the high-pressure side pressure becomes higher when the high-pressure side pressure is equal to or larger than predetermined value Ph1, as illustrated in FIG. 6. That is, predetermined value ΔI0 that becomes smaller as the high-pressure-side pressure becomes higher is stored as a correlation equation or a table in the storage, and electric current controller 12 stops output of voltage command value V* in a case where change rate ΔI of an electric current is equal to or larger than predetermined value ΔI0 that depends on the pressure detected by high-pressure-side pressure detector 116 (see FIG. 1).

Figure 7:
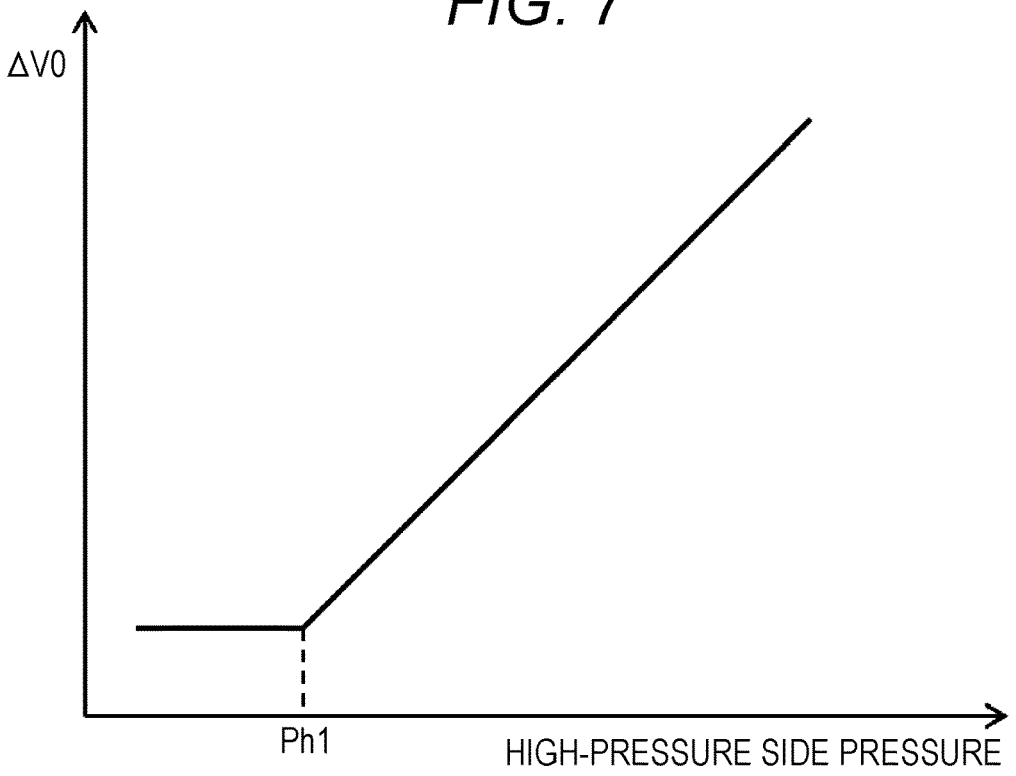
FIG. 7 illustrates a relationship between the high-pressure side pressure and a threshold value of a change rate of a direct current (DC) voltage value in the refrigeration cycle device according to the first exemplary embodiment of the present invention.

Change rate ΔV of a detection value detected by DC voltage detector 10 may be used instead of change rate ΔI of a detection value detected by electric current detection unit 9. That is, voltage value V detected by DC voltage detector 10 is sequentially stored in the storage. The DC voltage change rate computing unit computes change rate ΔV of a DC voltage value from voltage value V detected by DC voltage detector 10 and DC voltage value Va obtained a predetermined period before and stored in the storage. In a case where change rate ΔV of a DC voltage value is smaller than predetermined value ΔV0, electric current controller 12 stops output of voltage command value V*. In this case, predetermined value ΔV0 may be a threshold value set such that predetermined value ΔV0 is constant until the high-pressure side pressure reaches predetermined value Ph1 and predetermined value ΔV0 becomes larger as the high-pressure side pressure becomes higher when the high-pressure side pressure is equal to or larger than predetermined value Ph1, as illustrated in FIG. 7.

Events that can be a cause of occurrence of a disproportionation reaction in the refrigeration cycle device according to the present exemplary embodiment are described below.

A disproportionation reaction is likely to occur under a condition that a refrigerant is under excessively high temperature and pressure. Addition of a high energy source under high-temperature and high-pressure refrigerant atmosphere can trigger occurrence of the reaction. Therefore, in order to suppress a disproportionation reaction, it is necessary to prevent the refrigerant from being under excessively-high temperature and pressure atmosphere or prevent addition of a high energy source under high-temperature and high-pressure refrigerant atmosphere.

Situations where these phenomena occur in the refrigeration cycle device according to the present exemplary embodiment are considered below. First, a situation where temperature and pressure of a refrigerant become excessively high is considered below.

As a situation resulting from an indoor or outdoor blower fan, such a situation can be assumed in which heat release from a refrigerant to air does not progress because a blower fan does not work well and air blow is hindered on a condenser side where pressure of the refrigerant becomes high.

Specifically, as the situation where air blow is hindered, the following cases are, for example, assumed: a case where the blower fan on the condenser side stops due to a trouble, and a case where an air passage through which air is driven by the blower fan of the condenser is blocked by an obstacle. In a case where heat release from a refrigerant does not progress in the condenser, the temperature and pressure of the refrigerant in the condenser excessively rise.

As a situation resulting from a refrigerant side, there are cases where a refrigerant pipe is blocked due to breakage of part of the refrigerant pipe. Furthermore, there are cases where moisture (for example, vapor or, in the case of work in the rain, moisture in the atmosphere remains in a pipe due to insufficient vacuuming) or a residue such as small pieces that have been cut off (for example, small pieces cut off a pipe during pipe installation work remain) remains and accumulates in a pipe or an element (e.g., expansion valve 104) that constitutes the refrigeration cycle circuit so as to block the circuit due to a cause such as insufficient vacuuming of a refrigerant pipe during installation work or maintenance work. Furthermore, there are cases where the circuit is blocked because a worker who performs installation work forgets to open two-way valve 109 or three-way valve 108 and cases where a worker who performs pump down operation forgets to stop the operation (see FIG. 1).

In a case where the refrigeration cycle circuit is blocked during operation of compressor 102, pressure and temperature of a refrigerant from the discharge part of compressor 102 to the blocked part of the refrigeration cycle circuit excessively rise.

Since a disproportionation reaction is likely to occur under excessively high temperature and pressure as described above, these situations can be a cause of occurrence of a disproportionation reaction.

In order to secure safety, it is necessary to take a measure for preventing occurrence of a disproportionation reaction upon occurrence of the situations described above or a measure for minimizing breakage of the device even if the reaction occurs.

Next, situations where a high energy source is added in the refrigeration cycle device are considered.

Such situations are states where a predetermined operating condition is not met, for example, a state where discharge pressure (a high pressure side of the refrigeration cycle) excessively rises, for example, due to aforementioned stoppage of the blower fan on the condenser side or blockage of the refrigeration cycle circuit, or a state where a foreign substance is caught by a sliding portion of compression mechanism 102*c* of compressor 102. In such states, mechanical energy converted from electricity by the electric motor and transmitted to the compression mechanism exceeds an upper limit, and therefore the compression mechanism is unable to perform compression work for increasing pressure of a refrigerant any more. That is, lock abnormality of compressor 102 occurs (see FIG. 2).

In a case where electric power supply to compressor 102 is continued even in this state, electric power is excessively supplied to electric motor 102*e* that constitutes compressor 102. This causes electric motor 102*e* to abnormally generate heat. As a result, an insulator of a winding wire that constitutes stator 1022*e* of electric motor 102*e* is broken. This causes conductive wires of the winding wire to make direct contact with each other, thereby causing a phenomenon called a layer short. The layer short is a phenomenon involving occurrence of high energy under refrigerant atmosphere (discharge phenomenon) and therefore can be a trigger of a disproportionation reaction.

Excessive supply of electric power to electric motor 102*e* has a risk of causing not only the layer short, but also a short circuit resulting from breakage of a lead wire for supplying electric power to electric motor 102*e* or breakage of an insulator of the power feeding terminal. The short circuit at these portions also can be a trigger of a disproportionation reaction.

However, according to the present exemplary embodiment, electric motor 102*e* includes rotor 1021*e* including a permanent magnet. An electric motor having a permanent magnet in a rotor has high motor efficiency and therefore can reduce heat loss. Accordingly, it is possible to suppress excessive rise in temperature of electric motor 102*e*. It is therefore possible to suppress occurrence or progress of a disproportionation reaction.

Furthermore, since a number of turns of a three-phase winding wire can be made smaller as a result of improvement in motor efficiency, volume of a coil end can be reduced. This makes a layer short that often occurs in coil end 1023*e* less likely to occur, thereby suppressing occurrence or progress of a disproportionation reaction.

It is desirable that electric motor 102*e* be concentrated-winding electric motor. Concentrated winding makes it possible to further reduce a coil end. This makes the layer short that often occurs in the coil end less likely to occur. It is therefore possible to further suppress occurrence or progress of a disproportionation reaction.

It is desirable that the permanent magnet be a neodymium magnet. Since a neodymium magnet has larger magnetic force than other magnets, it is possible to reduce the number of turns of the three-phase winding wire. This makes it possible to reduce volume of coil end 1023*e*, thereby making the layer short that often occurs in coil end 1023*e* less likely to occur. It is therefore possible to suppress occurrence or progress of a disproportionation reaction.

Furthermore, since three lead wires 102*i* extend from coil end 1023*e* to power feeding terminal 102*h* while keeping a distance that is larger than the spacing between lead wires 102*i* in power feeding terminal 102*h*, spacing between lead wires 102*i* in airtight container 102*g* is large. This makes a layer short less likely to occur, thereby suppressing occurrence or progress of a disproportionation reaction.

Rotor position speed estimator 15 detects whether or not rotor 1021*e* is rotating on the basis of information on an input electric current to electric motor 102*e* or a magnetic pole position of rotor 1021*e*. In a case where estimated rotational speed of rotor 1021*e* is zero, i.e., in a case where it is estimated that rotor 1021*e* is not rotating in a state where target speed $\omega^*$ is not zero after rotation of compressor 102, electric current controller 12 stops output of voltage command value $V^*$.

That is, compressor 102 is stopped in a case where it is estimated that rotor 1021*e* is not rotating before issuance of an instruction to stop compressor 102 after activation of compressor 102.

Accordingly, excessive supply of electric power from electric motor driving device 115 to electric motor 102*e* does not occur in the state of torque shortage of electric motor 102*e*, i.e., in the state of lock abnormality of compressor 102. This makes it possible to prevent excessive supply of electric power to compressor 102 that can be a trigger of a disproportionation reaction, thereby suppressing occurrence or progress of a disproportionation reaction.

Furthermore, in a case where the target speed $\omega^*$ is not zero and where change rate $\Delta I$ of a detection value detected by electric current detection unit 9 is equal to or larger than predetermined value $\Delta I0$, electric current controller 12 stops output of voltage command value $V^*$. Since a rapid rise in electric current value that occurs upon occurrence of a layer short or the like can be detected by using change rate $\Delta I$ of a detection value detected by electric current detection unit 9, it is possible to stop supply of electric power from electric motor driving device 115 to electric motor 102*e* before progress of a disproportionation reaction.

The aforementioned control for stopping a command to rotate electric motor 102*e* by using change rate $\Delta I$ of a detection value detected by electric current detection unit 9 may be performed only in a case where pressure detected by high-pressure-side pressure detector 116 is equal to or higher than predetermined value Ph0. Alternatively, the aforementioned control for stopping a command to rotate electric motor 102*e* by using change rate ΔI of a detection value detected by electric current detection unit 9 may be performed only in a case where temperature detected by discharge temperature detector 117 is equal to or higher than predetermined value Td0 (see FIG. 1).

This makes it possible to block progress of a disproportionation reaction under high pressure and high temperature where the disproportionation reaction is likely to progress. As a result, safety improves. Furthermore, it is possible to prevent unnecessary stoppage of electric motor 102*e* under a condition where a disproportionation reaction is unlikely to progress.

Furthermore, predetermined value ΔI0 may be set so as to become smaller as the detection value detected by high-pressure-side pressure detector 116 becomes larger. This makes it possible to block progress of a disproportionation reaction under high pressure where the disproportionation reaction is likely to progress. Furthermore, it is possible to prevent unnecessary stoppage of electric motor 102*e* under a condition where a disproportionation reaction is unlikely to progress.

Furthermore, in a case where the target speed ω* is not zero and where change rate ΔV of a detection value detected by DC voltage detector 10 is smaller than predetermined value ΔV0, electric current controller 12 stops output of voltage command value V*. Since a rapid fall in DC voltage value that occurs upon occurrence of a layer short can be detected by using change rate ΔV of a detection value detected by DC voltage detector 10, it is possible to stop supply of electric power from electric motor driving device 115 to electric motor 102*e* before progress of a disproportionation reaction.

The aforementioned control for stopping a command to rotate electric motor 102*e* by using change rate ΔV of a detection value detected by DC voltage detector 10 may be performed only in a case where pressure detected by high-pressure-side pressure detector 116 is equal to or larger than predetermined value Ph0. Alternatively, the aforementioned control for stopping a command to rotate electric motor 102*e* by using change rate ΔV of a detection value detected by DC voltage detector 10 may be performed only in a case where temperature detected by discharge temperature detector 117 is equal to or higher than predetermined value Td0.

This makes it possible to block progress of a disproportionation reaction under high pressure and high temperature where the disproportionation reaction is likely to progress. As a result, safety improves. Furthermore, it is possible to prevent unnecessary stoppage of electric motor 102*e* under a condition where a disproportionation reaction is unlikely to progress.

Furthermore, predetermined value ΔV0 may be set so as to become larger as the detection value detected by high-pressure-side pressure detector 116 becomes larger. This makes it possible to block progress of a disproportionation reaction under high pressure where the disproportionation reaction is likely to progress. Furthermore, it is possible to prevent unnecessary stoppage of electric motor 102*e* under a condition where a disproportionation reaction is unlikely to progress.

As a measure to suppress occurrence of a disproportionation reaction, four-way valve 106 may be switched so as to achieve pressure equalization (switched to cooling operation in the case of heating operation or switched to heating operation in the case of cooling operation) in addition to the aforementioned stoppage of supply of electric power to compressor 102. Alternatively, opening/closing valve 113*a* may be opened such that the discharge side and the introduction side of compressor 102 communicate with each other through bypass pipe 113 in addition to the aforementioned stoppage of supply of electric power to compressor 102. Alternatively, relief valve 114 may be opened such that a refrigerant is released to an external space in addition to the aforementioned stoppage of supply of electric power to compressor 102. These measures make it possible to reduce a high-pressure side pressure in the refrigeration cycle circuit, thereby suppressing occurrence or progress of a disproportionation reaction.

Although a rotary compressor has been described above as compressor 102, compressor 102 may be a positive-displacement compressor such as a scroll compressor or a reciprocating compressor, or may be a centrifugal compressor.

As described above, the present invention includes a refrigeration cycle circuit that includes a compressor including an electric motor; a condenser; an expansion valve; and an evaporator; the compressor, the condenser, the expansion valve, and the evaporator being connected to each other. Furthermore, a working fluid containing 1,1,2-trifluoroethylene and difluoromethane is used as a refrigerant sealed in the refrigeration cycle circuit, an electric motor driving device that drives the electric motor is provided, and the electric motor driving device includes a rotational speed estimator.

According to this configuration, the electric motor driving device detects a rotation state of a rotor, and therefore supply of electric power to the electric motor can be stopped upon occurrence of rotation abnormality of the electric motor. This makes it possible to prevent excessive supply of electric power to the compressor that can be a trigger of a disproportionation reaction of the refrigerant. It is therefore possible to suppress occurrence or progress of a disproportionation reaction of the refrigerant.

The present invention may be configured such that the rotational speed estimator estimates rotational speed based on a detection value of an electric current input to the electric motor.

The present invention may be configured such that the electric motor includes a rotor and a stator disposed around the rotor, and the rotational speed estimator estimates rotational speed based on information on a magnetic pole position of the rotor.

The present invention may be configured such that the rotor includes a permanent magnet. An electric motor having a permanent magnet in a rotor has high motor efficiency and therefore can reduce heat loss. It is therefore possible to suppress excessive rise in temperature of the electric motor. Furthermore, since a number of turns of a winding wire can be made smaller as a result of improvement in motor efficiency, volume of a coil end can be reduced. This makes a layer short that often occurs in the coil end less likely to occur. It is therefore possible to suppress occurrence or progress of a disproportionation reaction of the refrigerant.

The present invention may be configured such that the stator is a concentrated-winding stator. Concentrated winding of the stator makes it possible to reduce the coil end. This makes a layer short that often occurs in the coil end less likely to occur. It is therefore possible to suppress occurrence or progress of a disproportionation reaction of the refrigerant.

The present invention may be configured such that the permanent magnet that constitutes the rotor is a neodymium magnet. Since the electric motor that includes a neodymium magnet in the rotor has higher motor efficiency, an excessive rise in temperature of the electric motor can be suppressed. Since a number of turns of a winding wire can be made smaller, it is possible to reduce volume of the coil end. This makes it possible to make a layer short that often occurs in the coil end less likely to occur. It is therefore possible to suppress occurrence or progress of a disproportionation reaction of the refrigerant.

The present invention may be configured such that the electric motor includes a rotor and a stator disposed around the rotor, the stator includes a three-phase winding wire including lead wires connected to a power feeding terminal, and spacing between adjacent ones of the lead wires on a stator side is larger than spacing between the adjacent ones of the lead wires on a power feeding terminal side.

According to this configuration, spacing between the lead wires in the compressor can be made large. This makes it possible to make a layer short that can be a trigger of a disproportionation reaction of the refrigerant less likely to occur, thereby suppressing occurrence or progress of a disproportionation reaction of the refrigerant.

The present invention may be configured such that the electric motor driving device includes an electric current detection unit that detects an electric current input to the electric motor, and supply of electric power to the electric motor is stopped in a case where a change rate of a detection value detected by the electric current detection unit becomes equal to or larger than a predetermined value. According to this configuration, it is possible to stop supply of electric power before progress of a disproportionation reaction of the refrigerant.

The present invention may be configured such that the electric motor driving device includes a voltage detector that detects a voltage input to the electric motor driving device, and supply of electric power to the electric motor is stopped in a case where a change rate of a detection value detected by the voltage detector becomes smaller than a predetermined value. According to this configuration, it is possible to stop supply of electric power before progress of a disproportionation reaction of the refrigerant.

The present invention may be configured to further include a high-pressure-side pressure detector that is provided between a discharge part of the compressor and an inlet of the expansion valve, in which the predetermined value is made smaller as a detection value detected by the high-pressure-side pressure detector becomes larger. According to this configuration, it is possible to stop supply of electric power with more certainty before progress of a disproportionation reaction of the refrigerant. As a result, safety improves.

The present invention may be configured to further include a high-pressure-side pressure detector that is provided between a discharge part of the compressor and an inlet of the expansion valve, in which the predetermined value is made larger as a detection value detected by the high-pressure-side pressure detector becomes larger. According to this configuration, it is possible to stop supply of electric power with more certainty before progress of a disproportionation reaction of the refrigerant.

The present invention may be configured such that the electric motor driving device includes an electric current detection unit that detects an electric current input to the electric motor, and the electric motor driving device detects an electric current input to the electric motor. Furthermore, the present invention may be configured such that supply of electric power to the electric motor is stopped in a case where a detection value detected by the high-pressure-side pressure detector becomes equal to or larger than a predetermined value and where a change rate of a detection value detected by the electric current detection unit becomes equal to or larger than a predetermined value. According to this configuration, it is possible to stop supply of electric power with more certainty before progress of a disproportionation reaction of the refrigerant.

The present invention may be configured such that the electric motor driving device includes a voltage detector that detects a voltage input to the electric motor driving device, and the electric motor driving device detects a voltage input to the electric motor driving device. Furthermore, the present invention may be configured such that supply of electric power to the electric motor is stopped in a case where a detection value detected by the high-pressure-side pressure detector becomes equal to or larger than a predetermined value and where a change rate of a detection value detected by the voltage detector becomes smaller than a predetermined value. According to this configuration, it is possible to stop supply of electric power with more certainty before progress of a disproportionation reaction of the refrigerant.

INDUSTRIAL APPLICABILITY

As described above, a refrigeration cycle device according to the present invention is suitable for use of a working fluid containing R1123 and is therefore applicable to a water heater, a car air-conditioner, a refrigerator-freezer, a dehumidifier, and the like.

The invention claimed is:

1. A refrigeration cycle device comprising a refrigeration cycle circuit that includes a compressor including an electric motor; a condenser; an expansion valve; and an evaporator; the compressor, the condenser, the expansion valve, and the evaporator being connected to each other, wherein a working fluid containing 1,1,2-trifluoroethylene and difluoromethane is used as a refrigerant sealed in the refrigeration cycle circuit, the refrigeration cycle device further includes an electric motor driving device that drives the electric motor, and the electric motor driving device includes a rotational speed estimator, wherein the electric motor driving device is configured to stop a supply of electric power to the electric motor upon occurrence of rotation abnormality of the electric motor, wherein the electric motor driving device includes an electric current detector that detects an electric current input to the electric motor, the refrigeration cycle device further includes a high-pressure-side-pressure detector that is provided between a discharge part of the compressor and an inlet of the expansion valve, the electric motor driving device detects an electric current input to the electric motor, and the electric motor driving device is configured to stop supplying electric power to the electric motor in cases where a detection value detected by the high-pressure-side pressure detector is equal to or larger than a predetermined value and where a change rate of a detection value detected by the electric current detector is equal to or larger than a predetermined value.

2. The refrigeration cycle device according to claim 1, wherein the rotational speed estimator estimates rotational speed based on a detection value of an electric current input to the electric motor.

3. The refrigeration cycle device according to claim 1, wherein the electric motor further comprises a rotor and a stator disposed around the rotor, and the rotational speed estimator estimates rotational speed based on information on a magnetic pole position of the rotor.

4. The refrigeration cycle device according to claim 3, wherein the rotor includes a permanent magnet.

5. The refrigeration cycle device according to claim 4, wherein the stator is a concentrated-winding stator.

6. The refrigeration cycle device according to claim 4, wherein the permanent magnet is a neodymium magnet.

7. The refrigeration cycle device according to claim 1, wherein the electric motor further comprises a rotor and a stator disposed around the rotor, the stator includes a three-phase winding wire including lead wires connected to a power feeding terminal, and spacing between adjacent ones of the lead wires on a stator side is larger than spacing between the adjacent ones of the lead wires on a power feeding terminal side.

8. A refrigeration cycle device comprising a refrigeration cycle circuit that includes a compressor including an electric motor; a condenser; an expansion valve; and an evaporator; the compressor, the condenser, the expansion valve, and the evaporator being connected to each other, wherein a working fluid containing 1,1,2-trifluoroethylene and difluoromethane is used as a refrigerant sealed in the refrigeration cycle circuit, the refrigeration cycle device further includes an electric motor driving device that drives the electric motor, the electric motor driving device includes a rotational speed estimator, the electric motor driving device includes an electric current detector that detects an electric current input to the electric motor, and the electric motor driving device is configured to stop supplying electric power to the electric motor when a change rate of a detection value detected by the electric current detector is equal to or larger than a predetermined value.

9. A refrigeration cycle device comprising a refrigeration cycle circuit that includes a compressor including an electric motor; a condenser; an expansion valve; and an evaporator; the compressor, the condenser, the expansion valve, and the evaporator being connected to each other, wherein a working fluid containing 1,1,2-trifluoroethylene and difluoromethane is used as a refrigerant sealed in the refrigeration cycle circuit, the refrigeration cycle device further includes an electric motor driving device that drives the electric motor, the electric motor driving device includes a rotational speed estimator, the electric motor driving device includes a voltage detector that detects a voltage input to the electric motor driving device, and the electric motor driving device is configured to stop supplying electric power to the electric motor when a change rate of a detection value detected by the voltage detector is smaller than a predetermined value.

10. The refrigeration cycle device according to claim 8, further comprising a high-pressure-side pressure detector that is provided between a discharge part of the compressor and an inlet of the expansion valve, wherein the predetermined value is made smaller as a detection value detected by the high-pressure-side pressure detector becomes larger.

11. The refrigeration cycle device according to claim 9, further comprising a high-pressure-side pressure detector that is provided between a discharge part of the compressor and an inlet of the expansion valve, wherein the predetermined value is made larger as a detection value detected by the high-pressure-side pressure detector becomes larger.

12. A refrigeration cycle device comprising:

a refrigeration cycle circuit that includes a compressor including an electric motor; a condenser; an expansion valve; and an evaporator; the compressor, the condenser, the expansion valve, and the evaporator being connected to each other, wherein a working fluid containing 1,1,2-trifluoroethylene and difluoromethane is used as a refrigerant sealed in the refrigeration cycle circuit, the refrigeration cycle device further includes an electric motor driving device that drives the electric motor, and the electric motor driving device includes a rotational speed estimator, wherein the electric motor driving device is configured to stop a supply of electric power to the electric motor upon occurrence of rotation abnormality of the electric motor, the electric motor driving device includes a voltage detector that detects a voltage input to the electric motor driving device, the refrigeration cycle device further includes a high-pressure-side pressure detector that is provided between a discharge part of the compressor and an inlet of the expansion valve, the electric motor driving device detects a voltage input to the electric motor driving device, and the electric motor driving device is configured to stop supplying electric power to the electric motor in cases where a detection value detected by the high-pressure-side pressure detector is equal to or larger than a predetermined value and where a change rate of a detection value detected by the voltage detector is smaller than a predetermined value.

* * * * *